United States Patent [19]

McCartney

[11] 4,095,929

[45] Jun. 20, 1978

[54] LOW BTU GAS HORIZONTAL BURNER

[75] Inventor: Michael S. McCartney, Bloomfield, Conn.

[73] Assignee: Combustion Engineering, Inc., Windsor, Conn.

[21] Appl. No.: 777,219

[22] Filed: Mar. 14, 1977

[51] Int. Cl.[2] ..... F23N 1/02

[52] U.S. Cl. ..... 431/19; 431/90; 431/175; 431/188; 431/284; 239/404; 239/422; 239/424

[58] Field of Search ..... 431/19, 89, 90, 174, 431/175, 183, 184, 284, 285; 239/400, 404, 412, 422, 424

[56] References Cited

U.S. PATENT DOCUMENTS

| | | | |
|---|---|---|---|
| 1,801,431 | 4/1931 | Irish | 431/125 |
| 1,865,983 | 7/1932 | Warner | 431/183 |
| 2,823,628 | 2/1958 | Poole et al. | 431/174 |
| 3,074,361 | 1/1963 | Huge et al. | 431/284 |
| 3,180,395 | 4/1965 | Reed | 431/285 |
| 3,284,008 | 11/1966 | Miller | 431/19 |
| 3,486,834 | 12/1969 | Frey et al. | 431/284 |
| 3,649,155 | 3/1972 | Sharan | 431/19 |
| 3,729,285 | 4/1973 | Schwedersky | 431/284 |

*Primary Examiner*—Carroll B. Dority, Jr.
*Attorney, Agent, or Firm*—Wayne H. Lang

[57] ABSTRACT

Apparatus for burning a product gas having a low BTU content wherein a single burner is adapted to burn the low energy gas alone with the turndown capability of a multi-burner arrangement. The gas flow is separated into two independent flow streams with one flow stream being exhausted into a primary air stream and the other into a secondary air stream prior to combustion. A common control means responsive to changes in load is provided to modulate the secondary air stream and its associated gas stream whereby at decreasing loads proportionately increased amounts of air and gas are directed through the primary air and gas streams.

2 Claims, 2 Drawing Figures

LOW BTU GAS HORIZONTAL BURNER

BACKGROUND OF THE INVENTION

Known burners for a low energy product gas are designed to burn the low energy gas together with a high energy support fuel whereby the several fuels might achieve a predetermined output through the use of a multiple burner arrangement. In such a multiple burner arrangement, one or more burners thereof may be taken out of service at low loads to facilitate turndown, while under conditions calling for full load, all burners are pressed into maximum operation.

In a typical burner designed for low energy fuel, the entire amount of fuel and air required for complete combustion is mixed together and then directed through the throat of a burner, whereby the throat of the burner must be designed to carry the combined volume of fuel and combustion air. The volume of the low energy fuel used is frequently greater than the volume of air required to burn it, therefore a large burner throat is required. If the burner throat were made sufficiently large for low energy product gas, it would be oversized for high energy fuel, and it would be oversized for optimum flame stability when burning low energy gas under conditions of low load.

SUMMARY OF THE INVENTION

The present invention therefore relates to gas burning apparatus, and more particularly it relates to apparatus for the burning of gas with a low BTU content whereby a single burner is effective over a wide range of loads to provide the turndown capability of a multi-burner arrangement.

In the design of burners for heat generating equipment it is a primary objective to provide a burner arrangement that functions effectively at all loads and over a wide range of conditions. With a current necessity that low energy process gas and other low energy gas not be wasted, there is a further requirement that all gas having a low BTU content and a low gas pressure be provided with effective burning apparatus. Due to cost and size limitations on burners of this type, it is a still further requirement that no more than a single burner be used.

The design of this burner accordingly overcomes the problems that accompany the use of an oversized throat by dividing the fuel as well as the air into two independent streams in advance of the burner. A portion of the fuel is then supplied through the throat by a gas gun as a primary fuel, while the remaining stream of fuel bypasses the throat of the burner and is supplied when needed as a secondary fuel downstrem from the throat. At low load conditions, the secondary air and secondary fuel flow is completely terminated, however flow to the primary air and fuel lines continues to provide the same velocity and the same degree of turbulence established under conditions of full flow whereby there will be maximum flame stability and optimum combustion.

Therefore, a burner having a control system responsive to changes in load is provided to modulate the secondary gas and air in accordance with a variation in load. As the load increases, an additional amount of gas required is injected downstream from the throat to maintain fluid flow through the throat substantially constant. At low burner loads all air and fuel are directed through the primary zone of the throat to maintain high velocity and turbulence of flow deemed necessary to provide maximum fuel and air mixing and the flame stability that results therefrom.

DESCRIPTION OF THE PREFERRED EMBODIMENT

Figure 1:
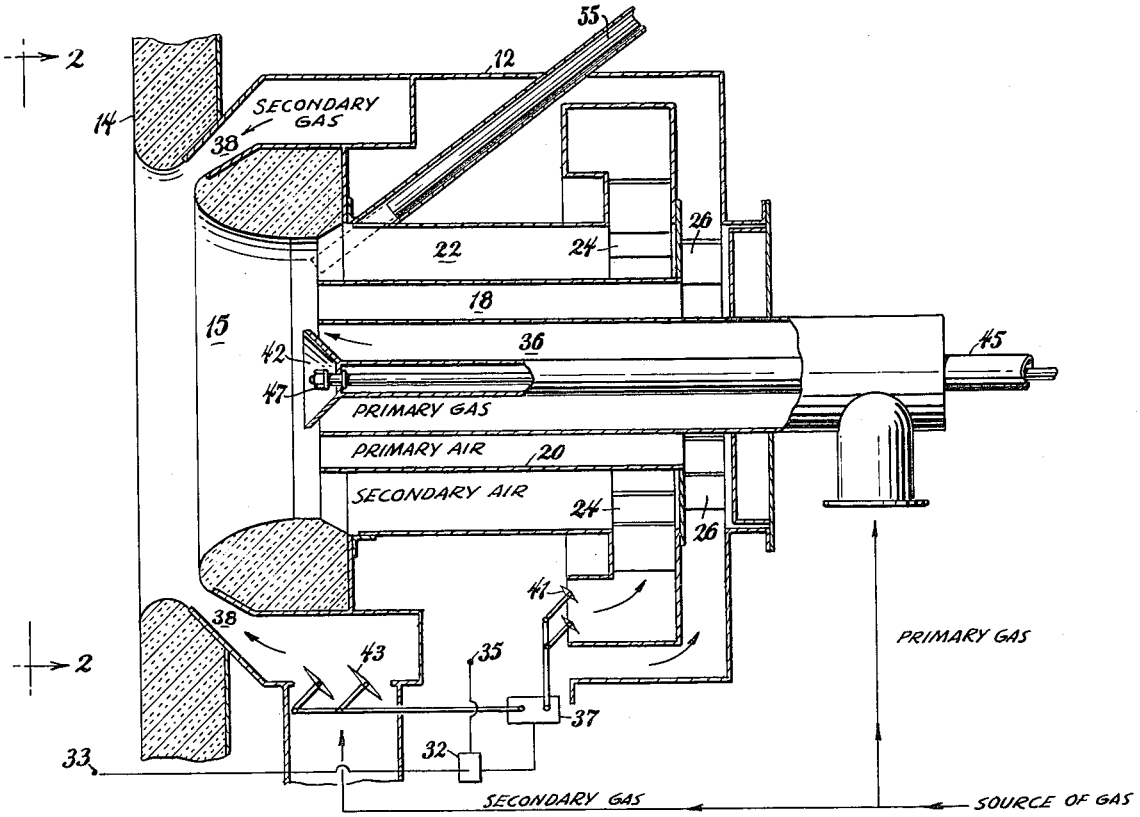
FIG. 1 is a side elevation in section showing a burner according to the present invention.
Figure 2:
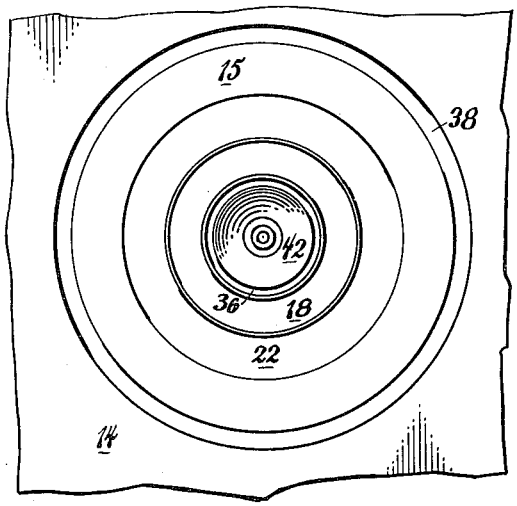
FIG. 2 is a front view of the burner as viewed from the arrows 2—2 of FIG. 1.

Referring to FIG. 1 wherein a burner according to this invention is contained in a windbox 12 that is attached to a furnace wall 14 with a single opening or throat 15 therein. The burner is provided with an air supply separated by a dividing wall 20 into passageways 18 for primary air that carries about 30% of the total air requirements, and a concentric passageway 22 for secondary air that carries about 70% of the total combustion air requirements. Each air stream enters the windbox and flows through a separate set of radial spinning vanes 24 and 26, respectively. The spinning motion of the primary air induces turbulence of the air and flame stability, while the spinning motion of the secondary air shapes the flame to the contour of the furnace. A control means 32 is responsive to a differential of pressure across pressure taps 33 and 35 whereby a change in pressure differential caused by varying load demands will generate a signal in the control means 32 operating drive unit 37 that moves linkages 39 for valves 41 in the passageway for secondary combustion air. The drive unit partially closes the secondary side of the damper when lesser amounts of air are required, thus maintaining a constant quantity of primary air flow in spite of the changing quantity of total combustion air. The damper in the secondary side of the damper box is the only item that moves during normal operation, since all other air side items are fixed after start-up.

External to the burner the fuel required for combustion is divided into two fuel streams. One of the fluid streams being supplied as a primary fuel flows continuously through a central passageway 36 that comprises approximately 25% of the total fuel requirements, while a secondary fuel stream comprises approximately 75% of the total fuel requirements and is admitted to the burner downstream from the throat thereof through the gas annulus assembly 38. The primary fuel enters the furnace through a central passageway 36 having a conical diffuser 42 at the end of a duet 45 that is manually movable axially to vary the velocity and pattern of the gas discharge. While the secondary fuel enters the furnace through the gas annulus assembly 38 situated downstream from the minimum throat diameter, its flow is regulated by dampers 43 that are operated by the same control means and is responsive to the same conditions as valves 41.

The fuel flow being supplied through the secondary gas annulus 38 is modulated in accordance with prevailing load conditions whereby the dampers 41 and 43 controlling the flow of gas and air to the secondary zones are closed completely below about one-third load, but are opened progressively at higher loads when the difference in pressure across taps 33 and 35 increases.

With the secondary fuel and air ducts closed off completely, the burner may still maintain optimum mixing at the primary air and fuel outlets because the volume of gas exhausting from ducts 22 and 36 is maintained continuously near maximum amounts of flow.

A high energy fuel such as oil is adapted to be supplied through a central duct 45 whose outlet is controlled by control means 47 in accordance with standard design.

A conventional ignitor 55 projects through the burner to the throat thereof to discharge a flame into said throat to ignite the fuel and air mixture being delivered in accordance with standard practice. Similarly, scanners as well as other general burner accessories may be supplied to complete the requirements for standard operation.

Thus it is to be seen that the dual fuel and air zone feature of this invention wherein the secondary fuel is exhausted into the furnace downstream from the throat of the burner eliminates oversizing a burner throat to accommodate maximum flow conditions. By this arrangement the velocity of fuel gas and air flow through the throat of a burner is maintained substantially constant whereby conditions of turbulence will remain constant and the flame stability will be maintained.

I claim:

1. Apparatus for burning a low energy gas comprising a furnace wall having a divergent opening for the exhaust of gas and combustion air therethrough, a windbox associated with said opening, a flow passageway in said windbox adapted to supply combustion air to said opening, a partition dividing said passageway into a primary air stream and a secondary air stream that exhaust into said opening, a burner in said opening for the generation of a flame, a source of supply for a quantity of fuel gas, a primary gas duct extending from the source of supply to said burner to exhaust continuously into said opening, and means forming an outlet port downstream from and concentrically surrounding said divergent opening adapted to exhaust a stream of secondary gas into the secondary air stream without increasing gas flow through said opening.

2. The apparatus of claim 1 having modulating means regulating the flow of secondary gas and airincluding a control means responsive to burner load adapted to control the modulating means whereby the flow therethrough increases as the pressure in the furnace and in the air duct increases.

* * * * *